United States Patent [19]

Latka

[11] Patent Number: 5,029,512

[45] Date of Patent: Jul. 9, 1991

[54] FIREARM MUZZLE SILENCER

[76] Inventor: Gregory S. Latka, 1119 Herbert J, Jackson, Mich. 49202

[21] Appl. No.: 509,186

[22] Filed: Apr. 16, 1990

[51] Int. Cl.[5] ..... F41A 21/30

[52] U.S. Cl. ..... 89/14.4; 181/223; 181/280

[58] Field of Search ..... 89/14.4, 14.3; 181/223, 181/279, 280

[56] References Cited

U.S. PATENT DOCUMENTS

| | | | |
|---|---|---|---|
| 916,885 | 3/1909 | Maxim | 89/14.4. |
| 1,017,003 | 2/1912 | Kenney | 89/14.4. |
| 1,341,363 | 5/1920 | Fiala | 89/14.4 |
| 2,792,760 | 5/1957 | Hammer | 89/14.4 |
| 2,925,755 | 2/1960 | Krus | 89/14.3 |
| 3,500,955 | 3/1970 | Werbell | 89/14.2 |
| 3,667,570 | 6/1972 | Werbell | 89/14.4 |
| 3,748,956 | 7/1973 | Hubner | 89/14.4 |
| 4,291,610 | 9/1981 | Waiser | 89/14.4 |
| 4,576,083 | 3/1986 | Seberger, Jr. | 89/14.4 |
| 4,588,043 | 5/1986 | Finn | 181/223 |

FOREIGN PATENT DOCUMENTS

| | | | |
|---|---|---|---|
| 2824546 | 12/1979 | Fed. Rep. of Germany | 89/14.4 |
| 793373 | 1/1936 | France | 89/14.4 |
| 981733 | 5/1951 | France | 89/14.4 |
| 249607 | 8/1926 | Italy | 181/279 |
| 27930 | of 1910 | United Kingdom | 89/14.4 |

*Primary Examiner*—Deborah L. Kyle
*Assistant Examiner*—Stephen Johnson
*Attorney, Agent, or Firm*—Beaman & Beaman

[57] ABSTRACT

A silencer or noise suppressor for firearms consisting of an elongated body connected to the firearm muzzle into which the expanding gases and projectile are received. The expanding gases are initially received within a chamber and pass through ports defined in a deceleration plate into a chamber communicating with a plurality of baffles arranged in end-to-end relationship. The baffles each include a diverging bore through which the gases may expand, and externally, each baffle includes a spiral vane receiving the expanding and cooling gases. The vanes of adjacent baffles are in communication whereby gas back-pressure within portions of the vanes cause localized gas compression slowing gas expansion and the generation of audible frequencies.

9 Claims, 1 Drawing Sheet

FIREARM MUZZLE SILENCER

BACKGROUND OF THE INVENTION

Firearm muzzle silencers absorb and reduce the audible frequencies and vibrations occurring from the rapid expansion of gases leaving a firearm muzzle as the projectile leaves the gun bore. Such devices, in addition to reducing audible frequencies, also contain and arrest muzzle flash. Silencers, conventionally, are designed to temporarily contain and divert the expanding gases, and necessarily, effective firearm silencers must be relatively large and bulky to accommodate the large volume of expanding gas, especially with higher caliber firearms.

Firearm silencers or suppressors are known wherein a plurality of baffles or elements are mounted within the silencer body in axially aligned relationship wherein the baffles include conical or expanding volume bores. U.S. Pat. Nos. 1,017,003; 4,291,610 and 4,576,083 disclose this type of construction in a muzzle silencer.

It is also known to employ spiral baffles or vanes in firearm silencers for increasing the gas path of movement length and arresting gas expansion, and U.S. Pat. Nos. 1,341,363; 2,792,760 and 3,500,955 disclose silencers using such spiral vanes.

U.S. Pat. No. 3,667,570 discloses a silencer incorporating both baffles having diverging bores, and spiral vanes located on the exterior surface of baffles. However, in this patent the two different types of suppressor elements are located in series with respect to the axial length of the silencer, and effective silencing with this type of construction requires a silencer of considerable axial dimension.

It is an object of the invention to provide an effective firearm silencer or suppressor of concise configuration wherein audible frequencies, and muzzle flash, are effectively confined in a body of concise axial configuration and the expansion of gases is rapidly dissipated.

Yet another object of the invention is to provide an effective concise firearm muzzle silencer including gas expansion chambers and a plurality of baffles having bores permitting gas expansion and exterior vanes defining an elongated gas flow path to decelerate and cool the expanding gases.

A further object of the invention is to provide a concise firearm muzzle silencer which is of economical construction, may be readily assembled, and is rugged and readily serviceable by the unskilled.

In the practice of the invention an elongated cylindrical body includes a mounting end and a projectile outlet end. The adapter end is mounted upon the firearm, and first and second gas expansion chambers are defined adjacent the adapter. Expanding gas leaving the second chamber communicates with a spiral gas expansion flow chamber defined by a plurality of communicating spiral vanes defined on short baffles stacked in an axial end-to-end relationship.

Internally, each baffle includes a bore of expanding volume in the direction of projectile and gas movement, and externally, each baffle includes a spiral vane communicating with the flow path defined by the spiral vanes of adjacent baffles. The downstream portion of the vanes of each baffle communicate with the upstream vane portions of the adjacent baffle wherein expanding gases leaving the vanes of one baffle enter the vanes of the adjacent baffle in the direction of gas expansion. This "back pressure" causes a compression with respect to gas expansion effectively absorbing and dissipating the expanding gases and audible frequencies.

A final expansion chamber is defined adjacent the silencer outlet cap, and the cap includes a shrouded bore tending to confine and restrict gas flow through the cap, adding to the audible suppression produced by the invention.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENTS

Figure 1:
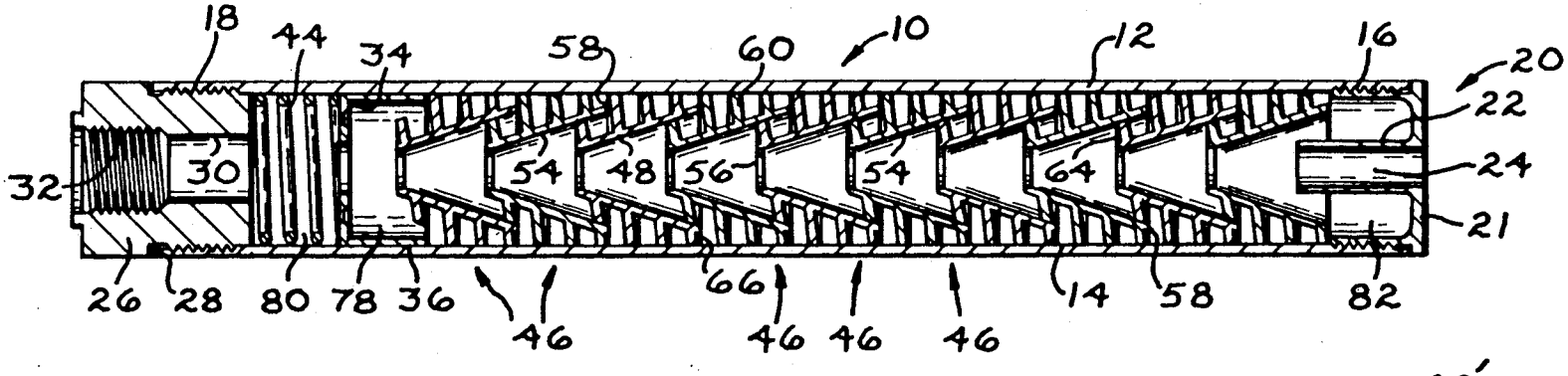
FIG. 1 is a diametrical elevational sectional view of a firearm muzzle silencer in accord with the invention.

A firearm muzzle silencer or suppressor utilizing the concepts of the invention is illustrated in its entirety in FIG. 1. The silencer, generally designated by the numeral 10, includes a cylindrical annular body 12 having a cylindrical bore 14 axially extending therethrough. Internally, the bore 14 is threaded at 16 at its outlet end, and is threaded at 18 at its inlet end.

The silencer body outlet end is enclosed by a cap 20 including a radially extending end wall 21. The cylindrical axially extending portion of the cap is threaded for mating with the body threads 16, and an axially extending annular neck 22 projects within the cap having a bore 24 slightly larger than the projectile which will pass through the silencer.

The silencer mounting adapter 26 includes external threads for mating with the body threads 18, and a radial shoulder defined upon adapter 26 abuts against the left end of the body 12 as viewed in FIG. 1. The adapter 26 includes the axial bore 30 which is threaded at 32 whereby the mounting adapter and entire silencer 10 may be threaded upon the threads of the firearm barrel, not shown, with which the silencer is to be employed. This type of threaded silencer mounting is well know in the art.

Figure 3:
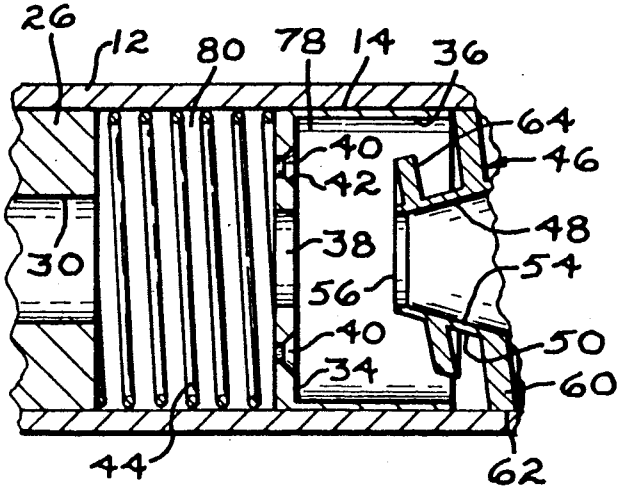
FIG. 3 is an enlarged diametrical elevational sectional view of the adapter end, gas deceleration plate and compression spring.

A gas deceleration plate 34 is mounted within the body bore 14 axially spaced from the mounting plate 26. The plate 34 includes a cylindrical portion 36 axially slidably supported within the bore 14, and centrally, the plate 34 includes the bore 38 of a diameter slightly greater than the diameter of the projectile. A plurality of gas deceleration ports 40 are defined in the plate 34, and the ports 40 each include a surface 42 diverging to the right, FIG. 3. A compression spring 44 interposed between the mounting adapter 26 and the deceleration plate 34 biases the plate 34 to the right, FIG. 1, for maintaining the baffles in contiguous relationship, as will be later apparent.

A plurality of short baffles 46 are located within the body bore 14 in end-to-end relationship between the gas deceleration plate 34 and the cap 20. Each of the baffles 46 are identical, and each includes a conical body 48 diverging toward the cap 20. The body 48 includes a conical outer surface 50, and the body also defines the diverging bore 54 similarly configured to the outer surface 50 whereby the body 48 is of a substantially uniform wall thickness.

The inlet end of the baffles is indicated at 56, while the right or outlet baffle end is shown at 58. Externally, each of the baffles 46 is provided with a spiral vane 60 homogeneously formed of the same material as the body 48. The vane 60 includes a periphery 62 which is cylindrical and closely cooperates with the body bore 14. The left most-vane portion 64, as view in FIG. 1, enters the bore 54 of the baffle to the left, FIG. 1, and its periphery closely engages the adjacent baffle bore. The right end of each vane is indicated at 66, and coincides with the right end 58 of the associated baffle body.

Figure 4:
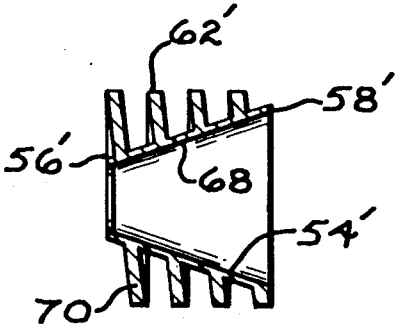
FIG. 4 is a diametrical elevational sectional view of another embodiment of baffle.
Figure 5:
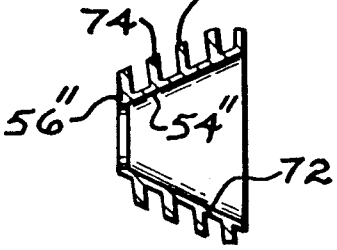
FIG. 5 is a diametrical elevational sectional view of a further embodiment of baffle construction.

Variations of the configuration of baffle vanes is shown in FIGS. 4 and 5 wherein elements identical to those previously described are indicated by primed references numerals.

With respect to the embodiment of FIG. 4, the baffle body 68 is similar in configuration to body 48, and the spiral vane 70 has a periphery throughout its length which is of constant diameter wherein the vane periphery is cylindrical and only slightly smaller in diameter than the body bore 14.

Figure 2:
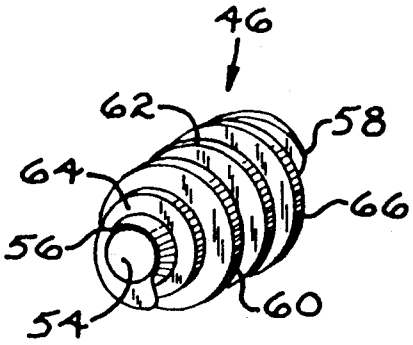
FIG. 2 is an elevational perspective view of a baffle, per se, as used with the embodiment of FIG. 1.

In FIG. 5 the baffle body 72 is of a conical diverging configuration and exteriorly includes the vane 74 having a periphery of reduced diameter of a conical configuration converging to the left, and toward the mounting adapter 26 when this embodiment of baffle is assembled within the silencer body 12. The configuration of the vane periphery 76 corresponds to the conical configuration of the associated baffle bore 54' wherein the baffles of the type of FIG. 5 will "nest" closely within each other even to a greater extent than the baffle configuration shown in FIGS. 1–3.

A chamber 78 is defined within the bore 16 intermediate the gas deceleration plate 34 and adjacent baffle 46, and a chamber 80 is defined within the body bore 14 intermediate the mounting adapter 26 and the gas deceleration plate 34. Additionally, a chamber 82 is defined within the silencer body adjacent the body outlet end by the cap 20 and cap neck 22.

In the practice of the invention the silencer 10 is mounted upon the firearm to be silenced, not shown, by threading the mounting adapter threads 32 upon the firearm bore threads wherein the axially passage defined through the silencer 10 by its various components is in alignment with the gun barrel.

Upon a bullet being fired the bullet and propelling gases rapidly move through the adapter bore 30 into the chamber 80. The greater diameter of the chamber 80 with respect to the adapter bore 30 permits the gases to rapidly expand within chamber 80, and this pressure is relieved by the gases expanding through the ports 40 defined in the gas deceleration plate 34. As the ports 40 include the diverging surfaces 42 further deceleration of the expanding gases occurs as the gases are introduced into the chamber 78.

The movement of the gases through the ports 40 diffuses the gas slowing the rapidly gas expansion, and the gas expanding through the ports 40 and received within the chamber 78 are "sheared off" and the expanding gas at the end 56 of the baffle 46 closest to the plate 34 enters the spiral path defined by the vanes of the nearest baffle 46 and the spiraled configuration of the vane 60 causes the gas movement to decelerate, and the gas temperature begins to cool.

As the projectile rapidly moves through the baffles 46 the trailing expanding gases behind the projectile will enter the baffle bores 54 and such expanding gases within the baffle bores also enters the paths defined by the vanes 60 as the vane ends adjacent the baffle ends 56 communicate with such gases. These expanding gases tend to enter the spiral flow path of the baffles 46 further permitting the gases to expand, cool and the gas movement slows.

As the gas expands through the baffles 46 the aforedescribed damping and absorption of the expanding gases by the vanes 60 and the diverging configuration of the baffle bores 54 continues to repeat producing a continuing absorption and deceleration of the gasses and the attendant audible frequencies created thereby.

As the gases move through the baffle vane spirals the gases cool, and the vanes direct the gases away from the center of the silencer. One of the effective results of the aforedescribed construction arises from the fact that the conical configuration of the baffle bodies 48 reduces the transverse cross-sectional area of the flow path defined by the vanes 60 of each baffle, and this reduction in gas flow path by each baffle further continues to slow and cool the expanding gas. Further, as the expanding gas leaving the end 58 of each baffle 46 will communicate with the baffle flow path of the adjacent "downstream" baffle vane some of this expanding gas will be directed toward the subsequent baffle left end 56 in an "upstream" manner against the movement of the expanding gases being forced into the same vane flow path. This reverse gas flow compresses the gases entering the baffle vane and further slows the gases as they expand behind the projectile.

As the left vane portion 64 periphery is small enough to be received within the baffle bore 58 of the adjacent "upstream" baffle the aforedescribed interrelationship between the gas flow of the baffles will occur, and as the projectile moves through the silencer the considerable volume of expanding gas as accommodated by the vanes 60 continues to decelerate and cool the expanding gas.

The expanding gases exiting the right-most baffle 46 as viewed in FIG. 1 will enter the chamber 82 adjacent the cap 20. Such gases will encounter the cap end wall 21 and be deflected in an upstream direction within chamber 82 further suppressing gas expansion and audible frequency generation.

The axial biasing force imposed upon the gas deceleration plate 34 and engaging baffles 46 will maintain the plate and baffles in a tight contiguous relationship assuring the flow between the baffles as indicated. The spring 44 will accommodate any axial expansion that occurs as the silencer temperature rises during use and assure trouble free operation.

By utilizing a plurality of baffles 46 having diverging bores, and spiral vanes formed on the exterior of the baffles an extensive length of gas absorbing flow path is achieved in a concise axial dimension. Preferably, the body 12 does not include perforations through which the gas may escape, and the gases within the projectile can only escape from the silencer body through the cap bore 24 after the projectile has left the silencer configuration.

When using baffles of the configuration shown in FIGS. 4 and 5 the principles and concepts are similar to those previously described, and it will be appreciated that various other modifications to the inventive concepts may be apparent to those skilled in the art without departing from the spirit and scope of the invention.

I claim:

1. A firearm muzzle silencer comprising, in combination, an elongated annular body having an axial cylindrical bore, a firearm mounting end and a projectile discharge end, firearm mounting means defined on said firearm mounting end adapted to mount said body upon the muzzle of a firearm, an annular cap mounted upon said projectile discharge end, a plurality of axially spaced adjacent annular baffles each having an axial bore, an outer surface and first and second ends located within said axial bore of the body in an axially aligned relationship between said firearm mounting means and said cap, each of said baffles' bores diametrically expanding from said first end to said second end, and a single spiralled vane defined on each of said baffles' outer surfaces having a circumference extending several times about the associated baffle outer surface defining a spiralled path extending from said baffle first end to said baffle second end, said spiral paths each having an inlet adjacent the associated baffles' first end and an outlet adjacent the associated baffles' second end, said vanes' circumference adjacent the associated baffle first end being of a conical configuration corresponding to the configuration of said baffles' bores and said vanes' circumference configuration adjacent the associated baffle's second end being cylindrical and closely received within said body bore, said spiralled vanes' inlets each being received within and in communication with the bore of the adjacent baffle disposed toward said firearm mounting end except for the baffle closest to said firearm mounting end.

2. In firearm muzzle silencer as in claim 1, said baffles' bores being of a conical configuration diametrically expanding in an axial direction toward said cap.

3. In a firearm muzzle silencer as in claim 1, said vanes' paths outlet being in communication with the path inlet of the adjacent baffles vane in a direction toward said cap except for the baffle closest said cap.

4. In a firearm muzzle silencer as in claim 1, a transverse cross-sectional area of said baffles' vane spiral paths reducing in dimension from said vanes' inlet to said outlet.

5. In a firearm muzzle silencer as in claim 1, a spring within said axial bore of the body imposing an axial biasing force upon said baffles maintaining adjacent baffles in an engaging relationship.

6. In a firearm muzzle silencer as in claim 1, said annular body having an annular wall free of openings and ports.

7. A firearm muzzle silencer comprising, in combination, an elongated annular body having an axial bore, a firearm mounting end and a projectile discharge end, firearm mounting means defined on said firearm mounting end adapted to mount said body upon the muzzle of a firearm, an annular cap mounted upon said projectile discharge end, a plurality of axially spaced adjacent annular baffles each having an axial bore, an outer surface and first and second ends located within said axial bore of the body in an axially aligned relationship between said firearm mounting means and said cap, each of said baffles' bores diametrically expanding from said first end to said second end, and a spiralled vane defined on each of said baffles' outer surfaces each defining a spiralled path extending from said baffle first end to said baffle second end, said spiral paths each having an inlet adjacent the associated baffles' first end and an outlet adjacent the associated baffles' second end, said spiralled vanes' inlets each being in communication with the bore of the adjacent baffle disposed toward said firearm mounting end except for the baffle closest to said firearm mounting end, a first chamber defined in said body bore adjacent said firearm mounting means, a second chamber defined in said axial bore of the body adjacent said first chamber, an annular plate intermediate said chambers having an outer diameter and another axial bore, a plurality of gas receiving orifices defined in said plate intermediate said another axial bore and said outer diameter, said first end of the baffle nearest said firearm mounting means defining the end of said second chamber opposite to said plate, gas entering said second chamber through said orifices entering the vane path of said nearest baffle.

8. A firearm muzzle silencer comprising, in combination, an elongated annular body having an axial bore, a firearm mounting end and a projectile discharge end, firearm mounting means defined on said firearm mounting end adapted to mount said body upon the muzzle of a firearm, an annular cap mounted upon said projectile discharge end, a plurality of axially spaced adjacent annular baffles each having an axial bore, an outer surface and first and second ends located within said body bore in an axially aligned relationship between said firearm mounting means and said cap, a first chamber defined in said axial bore of the body adjacent said firearm mounting means, a second chamber defined in said body bore adjacent said first chamber, an annular plate intermediate said chambers having an outer diameter and another axial bore, a plurality of gas receiving orifices defined in said plate intermediate said another axial bore and said outer diameter, said first end of the baffle nearest said firearm mounting means defining the end of said second chamber opposite to said plate, each of said baffles including a spiral vane, the vanes of adjacent baffles being in communication, gas entering said second chamber through said orifices entering the vane of the baffle nearest said plate.

9. In a firearm muzzle silencer as in claim 8, said plate being axially displaceable within said axial bore of the body and engaging the nearest baffle, and a spring within said axial bore of the body biasing said plate toward said baffles and axially biasing said baffles into engagement with each other.

* * * * *